US007480954B1

(12) United States Patent
Houck

(10) Patent No.: US 7,480,954 B1
(45) Date of Patent: Jan. 27, 2009

(54) SINK DISPOSER STUFFER AND SCRAPER TOOL

(76) Inventor: Theresa A. Houck, 1711 Aquita Dr., Pueblo, CO (US) 81008

( * ) Notice: Subject to any disclaimer, the term of this patent is extended or adjusted under 35 U.S.C. 154(b) by 0 days.

(21) Appl. No.: 11/824,733

(22) Filed: Jul. 3, 2007

(51) Int. Cl.
*A47L 25/00* (2006.01)

(52) U.S. Cl. ..... 15/105; 15/236.01; 4/286; 4/295; 81/488

(58) Field of Classification Search ..... 15/105, 15/236.01; 4/286, 293, 295; D32/35, 40, D32/42, 46–49; 81/488
See application file for complete search history.

(56) References Cited

U.S. PATENT DOCUMENTS 285,771 A * 9/1883 Turner ..... 15/105
4,268,080 A * 5/1981 Lindley ..... 294/1.1
4,297,761 A * 11/1981 Loos ..... 15/105
4,409,692 A * 10/1983 Ness ..... 4/286
4,504,996 A * 3/1985 Loos ..... 15/105
D292,835 S * 11/1987 Schaber ..... D32/35
5,224,234 A * 7/1993 Arsenault et al. ..... 15/167.1
5,404,596 A * 4/1995 Coory ..... 4/287
5,617,605 A * 4/1997 Hoerner et al. ..... 15/105
2006/0107476 A1 * 5/2006 Mameletzi et al. ..... 15/105

* cited by examiner

*Primary Examiner*—Mark Spisich

(57) ABSTRACT

A scraper and stuffer tool for a sink disposer having a split rubber entry portion in a bottom portion of a sink well comprises: a) an upper portion having a bottom portion sized to generally extend around a peripheral portion of the split rubber entry portion so that the tool can be carried/stored on and above the split rubber entry portion of the disposer; b) a central push portion extending centrally beneath the upper portion, configured to push food centrally through the split rubber entry portion into the disposer; c) a singular blade portion extending centrally across and beneath the push portion for scraping food off dishes and the sink into the disposer well; and, d) a top lift means extending centrally above the upper portion so that the tool can be lifted up and out of a storage/drain position in the well.

7 Claims, 1 Drawing Sheet

SINK DISPOSER STUFFER AND SCRAPER TOOL

FIELD OF THE INVENTION

Figure 1:
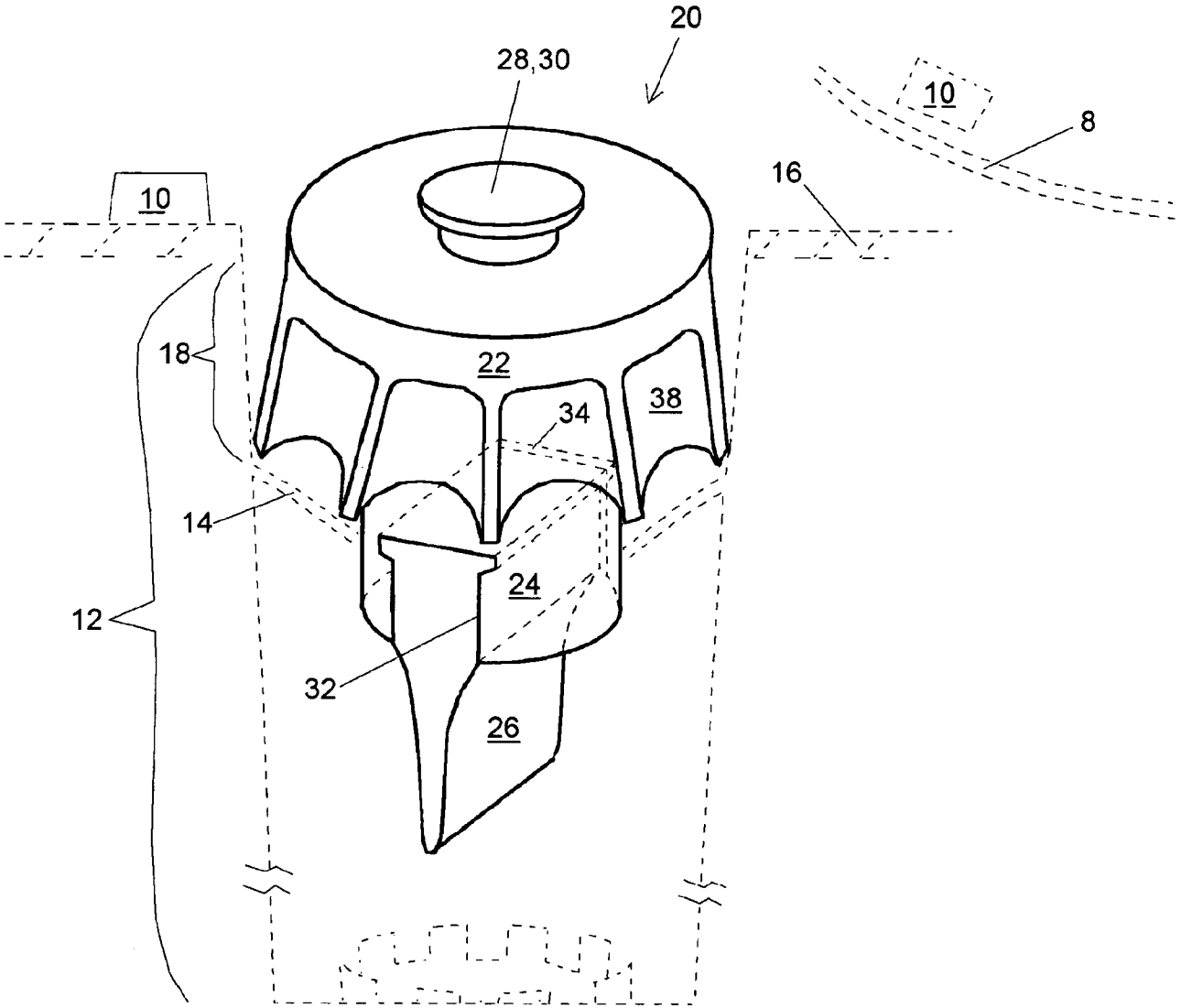

This invention relates to the use of sink mounted garbage disposers. More particularly this invention relates to a tool with which left-over food on dishes can be first scraped into the sink, and then with which the food in the sink can be stuffed into and through the well on the disposer. The tool is configured so that it can be carried and stored seated, on the flexible split rubber entry portion on a bottom portion of the disposer well in the sink. When seated in the storage position water and small food scrapings may drain through and around it.

BACKGROUND OF THE INVENTION

The inventor herein enjoys cooking and food preparation. She appreciates the best culinary tools. The tool disclosed herein was developed and manufactured to more efficiently and effectively scrape left-over food from dishes. After the left-over food is scraped from the dishes into the sink, the left-over food may be then be pushed and scraped through the disposer well in the sink into the disposer. One problem with disposers generally is that silverware and small utensils invariably occasionally slip into the garbage disposal unnoticed. These are then mangled when the disposer is turned on. The disclosed tool has an upper portion having a maximally sized outer diameter which allows it to be stored, and be carried, on and above the split rubber entry portion of the disposer. The outer lower peripheral portion of the upper portion of the tool is also symmetrically fluted therearound to facilitate drainage and funnel smaller pieces of food from the sink into the disposer while the tool is in the storage position. Because the surrounding space between the large outer diameter of the tool and the disposer well is insufficient to contain one's fingers, the tool includes a top knob so that it may be conveniently lifted from within the disposer well in the sink.

OBJECTS OF THE INVENTION

It is an object of this invention to disclose a very convenient and effective sink disposer, scraper and stuffer tool. It is an object of this invention to disclose a tool which because of its maximally sized outer diameter, and fluting, may be stored and carried on the split rubber entry portion of the disposer. It is an object of this invention to prevent silverware and small utensils from inconspicuously slipping into, and becoming mangled in the garbage disposal. Storing the tool in the garbage disposal prevents this from happening. It is yet a further object of this invention to disclose a sink disposer scraper and stuffer tool which may be conveniently lifted from a storage position within the disposer well in the sink, by a top knob which may be conveniently grasped.

One aspect of this invention provides for a scraper and stuffer tool for a sink disposer having a split rubber entry portion in a bottom portion of a sink well comprising: a) an upper portion having a bottom portion sized to generally extend around a peripheral portion of the split rubber entry portion so that the tool can be carried/stored on and above the split rubber entry portion of the disposer; b) a central push portion extending centrally beneath the upper portion, configured to push food centrally through the split rubber entry portion into the disposer; c) a singular blade portion extending centrally across and beneath the push portion for scraping food off dishes and the sink into the disposer well; and, d) a top lift means extending centrally above the upper portion so that the tool can be lifted up and out of a storage/drain position in the well.

In a preferred aspect of this invention the upper portion is generally cylindrical and loosely fills the sink well, and wherein the lift means comprises a knob extending centrally thereabove so that the tool may be lifted from the sink well without extending one's fingers around the upper portion, between the upper portion and the sink well.

Various other objects, advantages and features of this invention will become apparent to those skilled in the art from the following description in conjunction with the accompanying drawings.

FIGURES OF THE INVENTION

FIG. 1 is a perspective view of a sink disposer scraper and stuffer tool. The tool is shown in a storage position within a disposer well in a sink, carried on the split rubber entry portion of the disposer.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a sink disposer scraper and stuffer tool 20. The tool 20 is shown in a storage position within a disposer well 18 in a sink 16, carried on the split rubber entry portion 14 of the disposer 12. Most generally, a scraper and stuffer tool 20 for a sink disposer 12 having a split rubber entry portion 14 in a bottom portion of a disposer well 18 comprises: a) an upper portion 22 having a bottom portion sized to generally extend around a peripheral portion of the split rubber entry portion 14 so that the tool 20 can be carried/stored on and above the split rubber entry portion 14 of the disposer 12; b) a central push portion 24 extending centrally beneath the upper portion, configured to push food 10 centrally through the split rubber entry portion 14 into the disposer 12; c) a singular blade portion 26 extending centrally across and beneath the push portion 24 for scraping food 10 off dishes 8 and the sink 16 into the disposer well 18; and, d) a top lift means 28, 30 extending centrally above the upper portion 22 so that the tool 20 can be lifted up and out of a storage/drain position in the disposer well 18.

Most preferably the upper portion 22 is generally cylindrical and loosely fills the disposer well 18, and wherein the lift means 28 comprises a knob 30 extending centrally thereabove so that the tool 20 may be lifted from the disposer well 18 without extending one's fingers around the upper portion 22, between the upper portion 22 and the disposer well 18.

Most preferably the central portion 24 is generally cylindrical. In the most preferred embodiment of the invention the blade portion 26 comprises a flexible rubber/plastic to facilitate better scraping of curved portions on dishes 8. A lower portion of the central portion 24 comprises a central lateral slot 32 thereacross for lateral reception of an upper portion of the flexible blade portion 26 mated for lateral, but not vertical sliding reception therein. If a peripheral sidewall 34 of the push portion 24 extends across one end portion of the lateral slot 32, the blade portion 26 is thereby positioned and stopped from sliding therethrough.

In the most preferred embodiment of the invention the outer lower peripheral portion of the upper portion 22 is symmetrically fluted 38 therearound to facilitate drainage and funnel smaller pieces of food from the sink 16 into the disposer 12.

While the invention has been described with preferred specific embodiments thereof, it will be understood that this description is intended to illustrate and not to limit the scope of the invention, which is defined by the following claims.

I claim:

1. A scraper and stuffer tool for a sink disposer, the sink disposer having a split rubber entry portion fitted within a bottom portion of a sink well, comprising:

an upper portion having a bottom portion sized to generally extend around a peripheral portion of the split rubber entry portion so that the tool can be carried/stored on and above the split rubber entry portion of the disposer;

the upper portion having an outer lower peripheral portion that is fluted therearound to facilitate drainage of water and waste food into the disposer;

a central push portion extending centrally beneath the upper portion, configured to push food centrally through the split rubber entry portion into the disposer;

a singular blade portion extending centrally across and beneath the push portion for scraping food into the disposer, the blade portion being tapered such that the blade portion has a greater width where the blade portion meets the push portion and a lesser width where the blade portion terminates, wherein a lower portion of the central push portion comprises a lateral slot across a lower end of the central push portion for lateral reception of an upper portion of the blade portion mated for lateral, but not vertical, sliding reception therein; and, a top lift means extending centrally above the upper portion so that the tool can be lifted up and out of a storage/drain position in the disposer.

2. A tool as in claim 1 wherein the upper portion is both generally cylindrical and loosely fills the sink well, and wherein the lift means comprises a knob extending centrally above the upper portion so that the tool may be lifted from the disposer without extending one's fingers around the upper portion, between the upper portion and the disposer.

3. A tool as in claim 2 wherein the blade portion comprises a flexible rubber/plastic to facilitate better scraping of curved portions on dishes.

4. A tool as in claim 3 wherein a peripheral sidewall of the central push portion extends across one end portion of the lateral slot, thereby positioning and stopping the flexible blade portion from sliding completely through the lateral slot.

5. A tool as in claim 2 wherein a peripheral sidewall of the central push portion extends across one end portion of the lateral slot, thereby positioning and stopping the flexible blade portion from sliding completely through the lateral slot.

6. A tool as in claim 1 wherein the blade portion comprises a flexible rubber/plastic to facilitate better scraping of curved portions on dishes.

7. A tool as in claim 6 wherein a peripheral sidewall of the central push portion extends across one end portion of the lateral slot, thereby positioning and stopping the flexible blade portion from sliding completely through the lateral slot.

* * * * *